US006130497A

United States Patent [19]

Takezawa et al.

[11] Patent Number: 6,130,497

[45] Date of Patent: Oct. 10, 2000

[54] LIQUID COOLING TYPE CATHODE-RAY TUBE FOR A PROJECTOR

[75] Inventors: Hiroyuki Takezawa, Kanagawa, Japan; John Florek, Mount Pleasant, Pa.

[73] Assignees: Sony Corporation; Sony Electronics, Inc., both of Tokyo, Japan

[21] Appl. No.: 09/116,381

[22] Filed: Jul. 16, 1998

[30] Foreign Application Priority Data

Jul. 16, 1997 [JP] Japan ..... P09-191427

[51] Int. Cl.[7] ..... H01J 29/86

[52] U.S. Cl. ..... 313/35; 313/36; 313/44; 313/46

[58] Field of Search ..... 313/36, 44, 45, 313/477 R, 35, 46

[56] References Cited

U.S. PATENT DOCUMENTS

| | | | |
|---|---|---|---|
| 4,484,100 | 11/1984 | Sato | 313/44 |
| 4,717,853 | 1/1988 | Ezawa et al. | 313/35 |
| 4,737,678 | 4/1988 | Hasegawa | 313/36 |
| 4,899,080 | 2/1990 | Vriens et al. | 313/44 X |
| 5,115,163 | 5/1992 | Fitzpatrick et al. | 313/44 X |

*Primary Examiner*—Ashok Patel
*Attorney, Agent, or Firm*—Hill & Simpson

[57] ABSTRACT

A liquid cooling type cathode-ray tube for a projector comprising a coupler (43) mounted on the front surface (42*a*) of a cathode-ray tube body (42), which coupler serves as a cooling liquid sealing member and which is sealed with a cooling liquid (46) therein, the coupler (43) having a liquid fill hole (53) and a diaphragm (51) as a pressure regulating valve on the front surface thereof, and all of the mounting bores provided through the coupler being formed in the tubular axis direction of the cathode-ray tube body (42).

1 Claim, 10 Drawing Sheets

LIQUID COOLING TYPE CATHODE-RAY TUBE FOR A PROJECTOR

BACKGROUND OF THE INVENTION

1. Field of the Invention

The present invention relates to a liquid cooling type cathode-ray tube for a projector.

2. Description of the Related Art

Such a video projector has been known in which single-color cathode-ray tubes of red (R), green (G) and blue (B) are arranged in line and a projection lens located on the front surface of each of the single-color cathode-ray tubes focuses an image on a screen.

FIG. 1 shows a typical liquid cooling type cathode-ray tube for a projection which is used in a video projector.

This liquid cooling type cathode-ray tube 1 is constructed in such a manner that a coupler 3, which will become a cooling liquid sealing member, is mounted on the side of a panel front surface 2*a* of a single-color cathode-ray tube body 2, a final lens 5 of a projection lens system is mounted on an opening portion 4 of the coupler 3 opposing to the panel front surface 2*a* and a cooling liquid 6 is filled into the space surrounded by the panel front surface 2*a* of the single color cathode-ray tube body 2, the coupler 3 and the final lens 5.

The coupler 3 is fixed to the cathode-ray tube body 2 through a packing 7 by means of a fixing spring 8 so as to be tightly contacted on the panel front surface 2*a*.

The final lens 5 is fixed to the coupler 3 by a lens fixing plate 10 through a packing 9 so as to be tightly in contact with the coupler 3.

The coupler 3 has a liquid fill hole 12 on the side surface thereof in the direction perpendicularly to this side surface, and through the liquid fill hole 12, the cooling liquid 6 is filled into and fills the coupler 3.

The liquid fill hole 12 is formed with a screw (female screw) on the inner surface thereof and is sealed through an O-ring as a sealing member by a sealing screw 13 after the cooling liquid 6 is filled thereinto through the liquid fill hole 12.

On the side surface of the coupler 3 opposite to the liquid fill hole 12, a pressure regulating valve or bellofram 15 for regulating the pressure of the cooling liquid 6 is provided. This diaphragm 15 is held by a diaphragm holder 16. This diaphragm 15 may be made of a membrane which is made of, for example, ethylene-propylene rubber, a mixture of ethylenepropylene rubber and silicone, or butyl-rubber. The diaphragm 15 takes an equilibrium state, a state swelling to the open air and a state contracted towards the cooling liquid depending on the volume change of the cooling liquid 6 due to the temperature change. By this, the pressure regulation of the cooling liquid 6 is achieved.

The coupler 3 has a box portion 3A whose side in contact with the front surface 2*a* of the cathode-ray tube body 2 is opened and a flange portion 3B formed on the open end portion 32 thereof, which are formed integrally, as shown in FIG. 2 (a perspective view of the coupler 3 as seen from the front side thereof), FIG. 3 (a perspective view of the coupler 3 as seen by rotating FIG. 2 by 180 degree) and FIG. 4 (a perspective view of the coupler 3 as seen from the rear side thereof). The box portion 3A is formed with an opening portion 4 formed on its front surface 18 for mounting the final lens 5, a mounting bore 19 on one side surface of the box portion 3A for mounting the diaphragm 15 and the liquid fill hole 12 on the opposite side surface of the bore 19 which liquid fill hole 12 has the female screw on its inner surface. At four places on the rear surface of the flange portion 3B, formed integrally with the flange portion 3B are legs 20 (20A,20B,20C,20D), each having a threaded hole 20*a* on its tip end for mounting the coupler 3 to the cathode-ray tube body 2.

By the way, in the case of the above described coupler 3, the holes used for mounting other parts thereon are formed in two axial directions. That is, as shown in FIG. 2 to FIG. 4, the threaded holes 22 on the front surface 18 of the box portion 3A for mounting the lens fixing plate 10 and the through holes 23 of the flange portion 3B are formed in one axis direction Z (direction along the tubular axis of the cathode-ray tube 2 in FIG. 1), while the threaded holes 24 for fixing the diaphragm cover and the liquid fill hole (threaded bore) 12 are formed in the other axis direction Y perpendicular to the one axis Z.

Accordingly, at the time of assembly using such a coupler 3, since the screw tightening process is performed in four directions, or the front and rear sides and the right and left sides of the coupler 3, the assembly process becomes complicated.

On the other hand, if the coupler 3 having such threaded holes 22, 24, 12 and through holes 23 in the two axis directions is made by a die-casting method, as shown in FIG. 5, a metal mold 31 used therefor is formed of a fixed mold 32, a movable mold 33 and in addition thereto two inserts 34, 35. The metal mold 31 is opened by moving the movable mold 33 in an arrow direction a and the inserts 34, 35 in arrow directions b, c perpendicular to the arrow direction a (see FIG. 6), and is closed by moving the same in the inverse directions.

Such a metal mold 31 needs a complicated structure of metal mold because the inserts 34,35 should be operated by a slide mechanism which is provided separate from the opening and closing operation of the movable mold 33. Therefore, the cost of the metal mold increases and the durability thereof deteriorates. As a result, the cost of the molded coupler increases. Generally, although trimming precess and threading process are performed after metal mold molding (so-called casting) process, the machine for carrying out these processes should have a multi-axis mechanism, which causes a high manufacturing cost.

SUMMARY OF THE INVENTION

In view of the above points, the present invention is to provide a liquid cooling type cathode-ray tube for a projector, which can achieve a simple structure of the coupler, improvements in workability of the assembly process and the reduction of the cost.

A liquid cooling type cathode-ray tube for a projector according to the present invention has a cooling liquid sealing member mounted on the front surface of a cathode-ray tube body, which cooling liquid sealing member is provided with a liquid fill hole and a pressure regulating valve on the front surface thereof, and in which all of mounting holes or bores are formed in the tubular axis direction of the cathode-ray tube body.

According to this structure, since the liquid fill hole and the pressure regulating valve are provided on the front surface of the cooling liquid sealing member and all of the mounting holes or bores are formed in a single axis direction or tubular axis direction, the structure of the cooling liquid sealing member can be simplified and the cooling liquid sealing member can be molded by a simple metal mold.

The operation efficiency of assembly processes, for example, mounting other parts to the cooling liquid sealing member, mounting the cooling liquid sealing member to a cabinet of a cathode-ray tube through the flange of the cooling liquid sealing member or the like can be improved and also the assembly precision thereof can be improved.

DESCRIPTION OF THE PREFERRED EMBODIMENT

According to the present invention, in a liquid cooling type cathode-ray tube for a protector comprising a cooling liquid sealing member which is mounted on the front surface of a cathode-ray tube body and is sealed with a cooling liquid, the cooling liquid sealing member has a liquid fill hole and a pressure regulating valve on the front surface thereof, and all of mounting holes or bores formed through the cooling liquid sealing member are formed in the axis direction of the cathode-ray tube body.

Hereinafter, an example of the present invention will be described with reference to the attached drawings.

Figure 1:
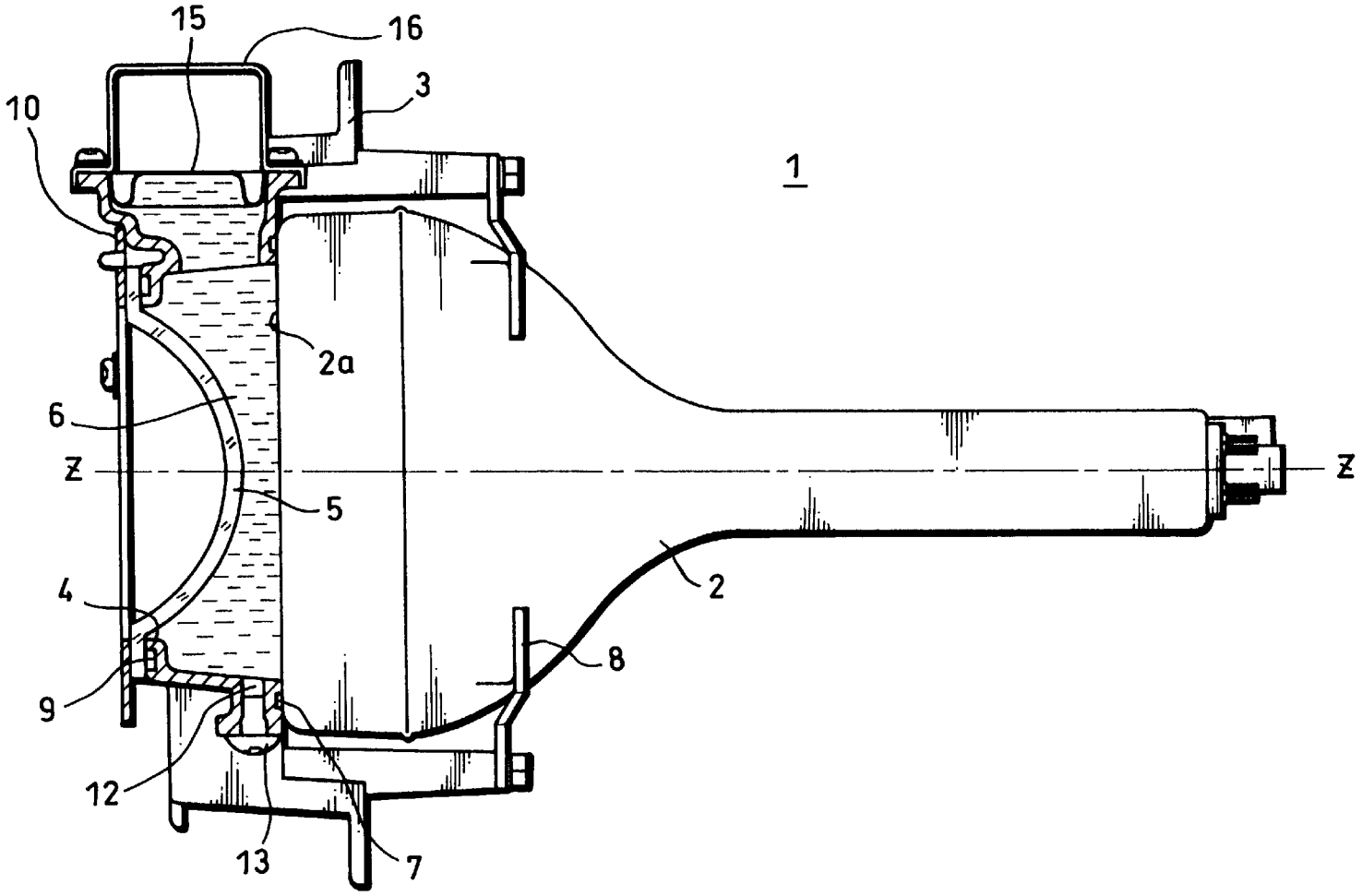
FIG. 1 is a structural view showing an example of the prior art liquid cooling type cathode-ray tube.
Figure 2:
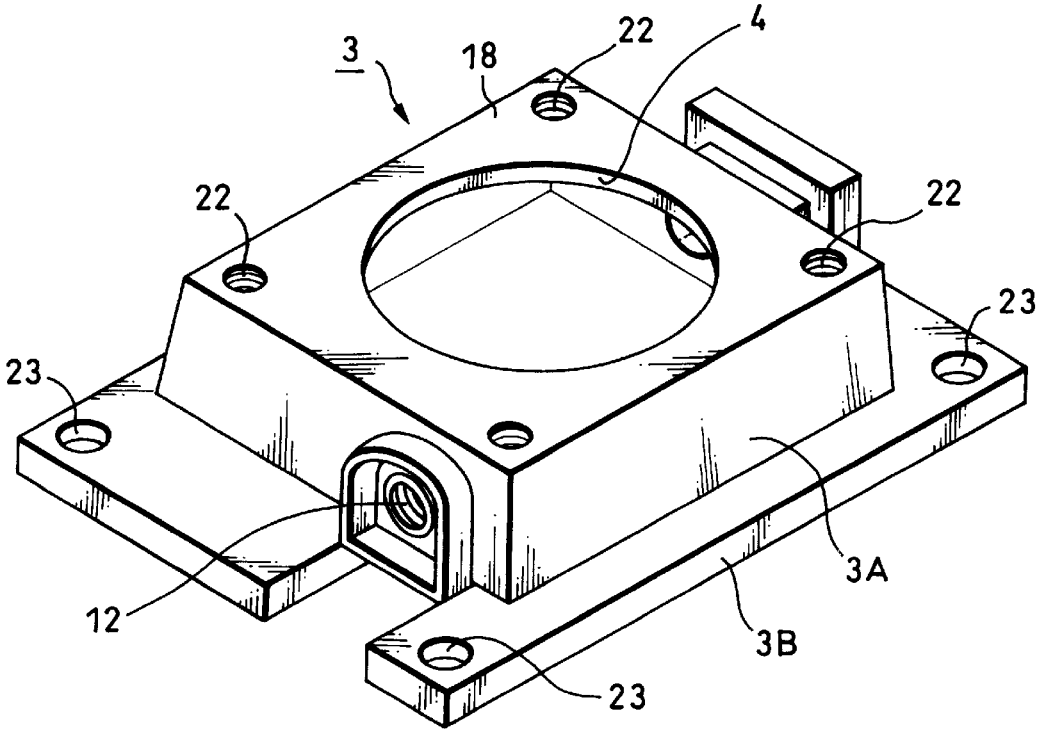
FIG. 2 is a perspective view of an example of the prior art coupler as seen from the front side thereof.
Figure 3:
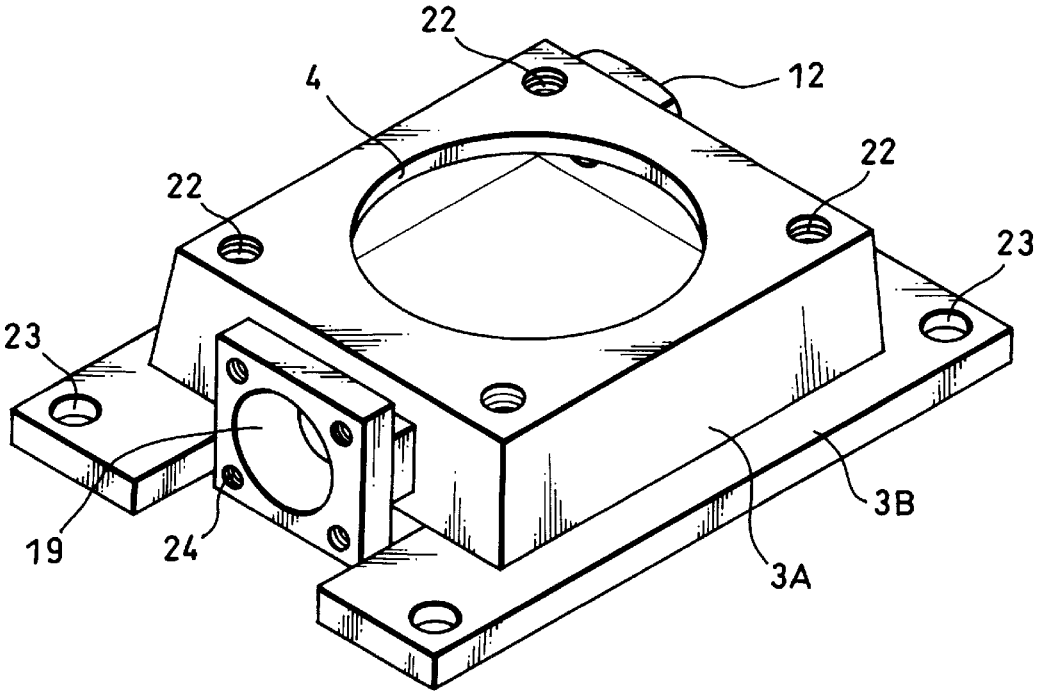
FIG. 3 is a perspective view showing a state by rotating the state of FIG. 3 by 180°.
Figure 4:
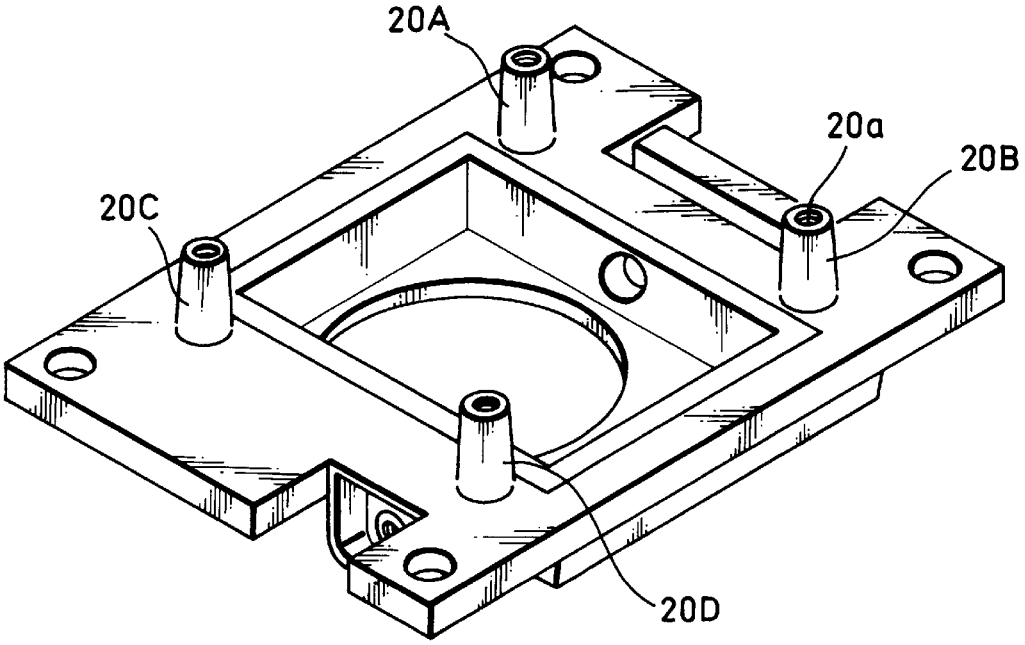
FIG. 4 is a perspective view of the coupler of FIG. 8 as seen from the rear side thereof.
Figure 5:
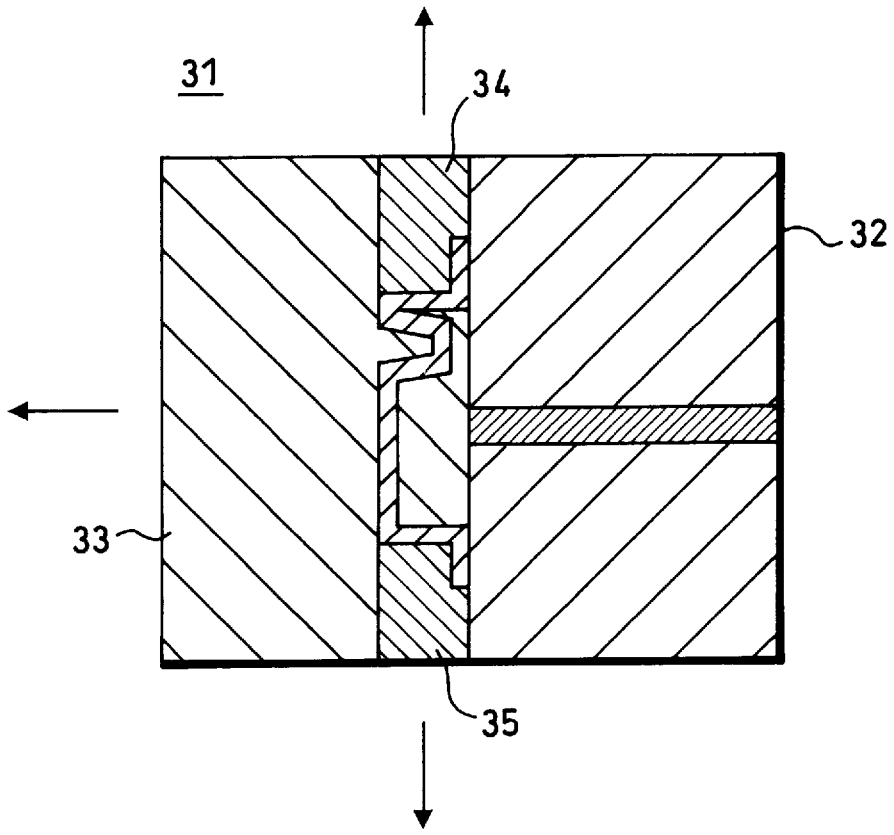
FIG. 5 is a schematic structural view of a metal mold for molding the coupler of FIG. 2 which is in a closed state.
Figure 6:
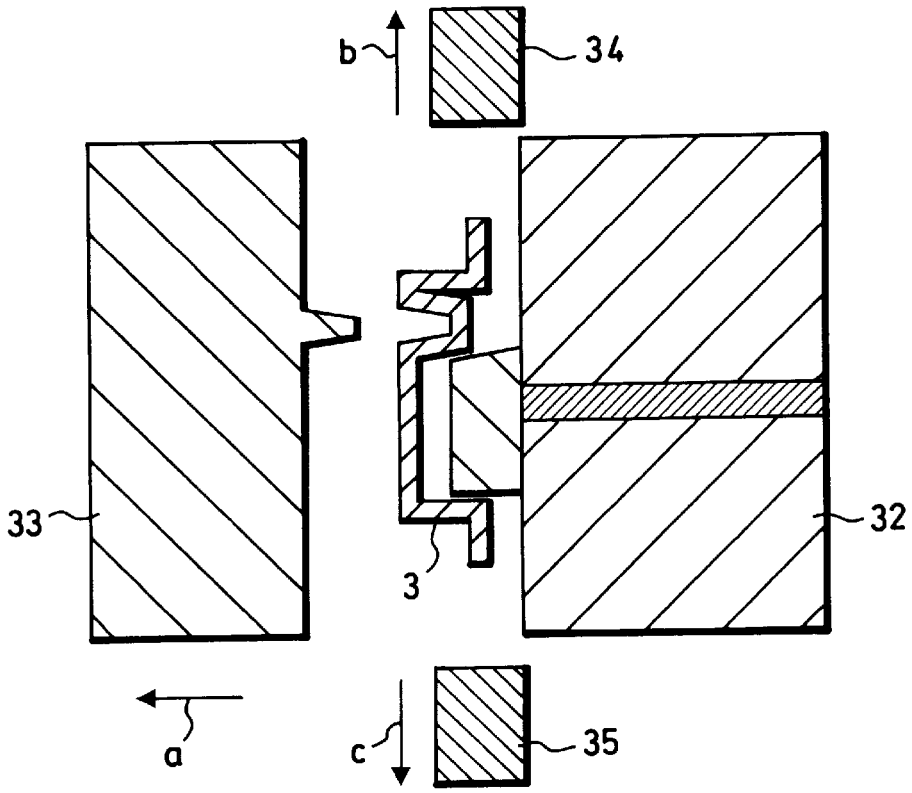
FIG. 6 is a schematic structural view of the metal mold of FIG. 5 which is in an opened state.
Figure 7:
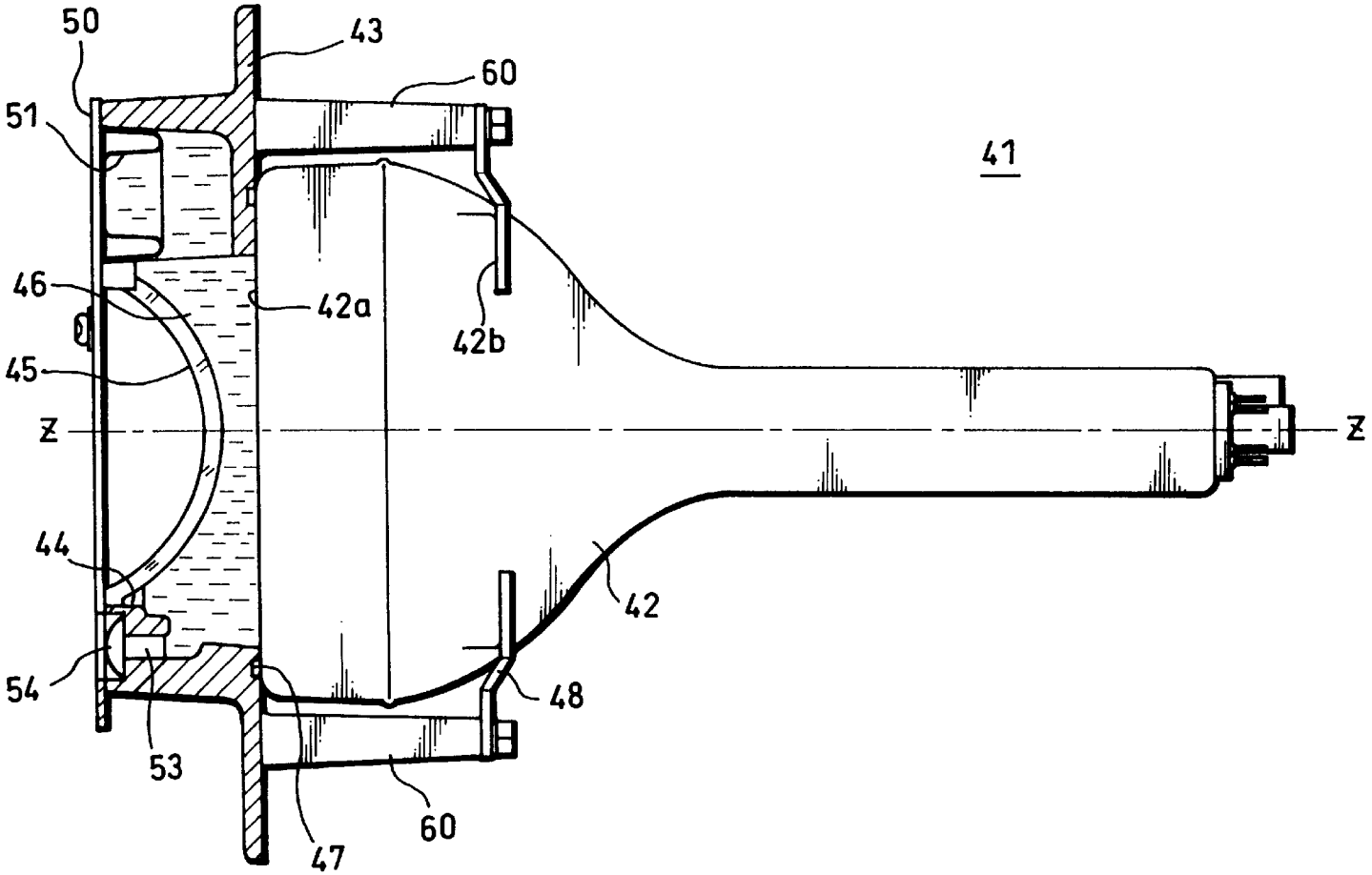
FIG. 7 is a structural diagram showing an embodiment of the liquid cooling type cathode-ray tube according to the present invention.

FIG. 7 shows an example of the liquid cooling type cathode-ray tube according to the present invention. This liquid cooling type cathode-ray tube 41 is formed such that a coupler 43 serving as a cooling liquid sealing member is fixed to a panel front surface 42*a* side of a single-color cathode-ray tube body 42, a final lens 45 of a projection lens system is closely fixed to an opening portion 44 of the coupler 43 opposing to the panel front surface 42*a*, and a cooling liquid 46 is filled into the space surrounded by the panel front surface 42*a* of the single-color cathode-ray tube body 42, the coupler 43 and the final lens 45.

The coupler 43 is fixed to the cathode-ray tube body 42 by means of a fixing spring 48 thorough a packing 47 at a state to be tightly in contact with the panel front surface 42*a*. In this case, the funnel portion of the cathode-ray tube body 42 is provided with an engaging step portion 42*b*, the fixing spring 48 is engaged with the engaging step portion 42*b*, the flange portion of the coupler 43 which will be detailed below is made in contact with the panel front surface 42*a*, and a leg portion 60 formed integrally with the flange portion 43B is fixed to the fixing spring 48 by a screw to thereby hold the cathode-ray tube body 42 between the fixing spring 48 and the flange portion 43B of the coupler 43, thus the coupler 43 being fixed.

The final lens 45 is fixed to the coupler 43 by a lens fixing plate 50 through a packing which is not shown in the drawing in a closely contact with the coupler 43. On the front surface of the coupler 43, a pressure regulating valve or diaphragm 51 for regulating the pressure of the cooling liquid 46 is mounted. This diaphragm 51 is held by the lens fixing plate 50. In other words, the lens fixing plate 50 is also utilized as a diaphragm holder.

On the front surface of the coupler 43, further a liquid fill hole 53 is provided, and, through the liquid fill hole 53, the cooling liquid 46 is filled into the inside of the coupler 43. On the inner surface of liquid fill hole 53 is formed a screw (female screw). The liquid fill hole 53 is sealed with a sealing screw 54 through a sealing member or an O-ring after the cooling liquid 46 is filled through the liquid fill hole 12.

Figure 8:
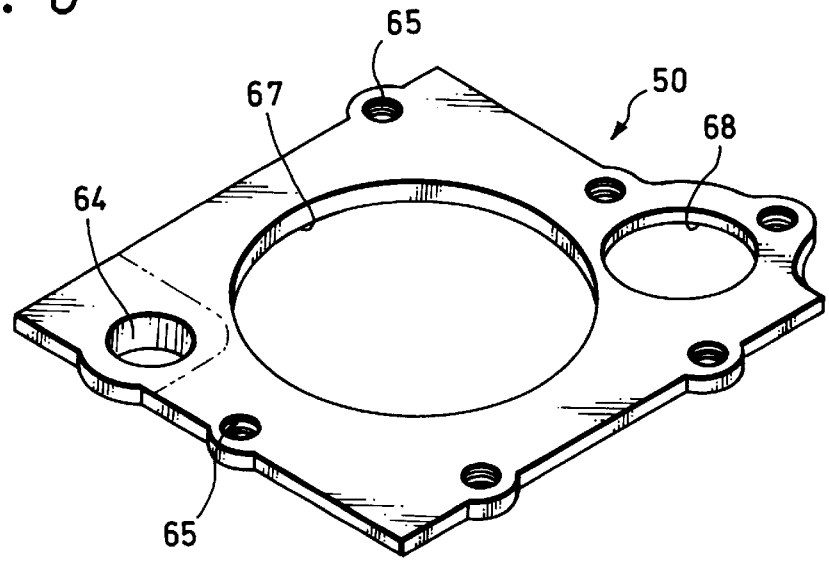
FIG. 8 is a perspective view showing an embodiment of the coupler used in the present invention as seen from the front side thereof.
Figure 8:
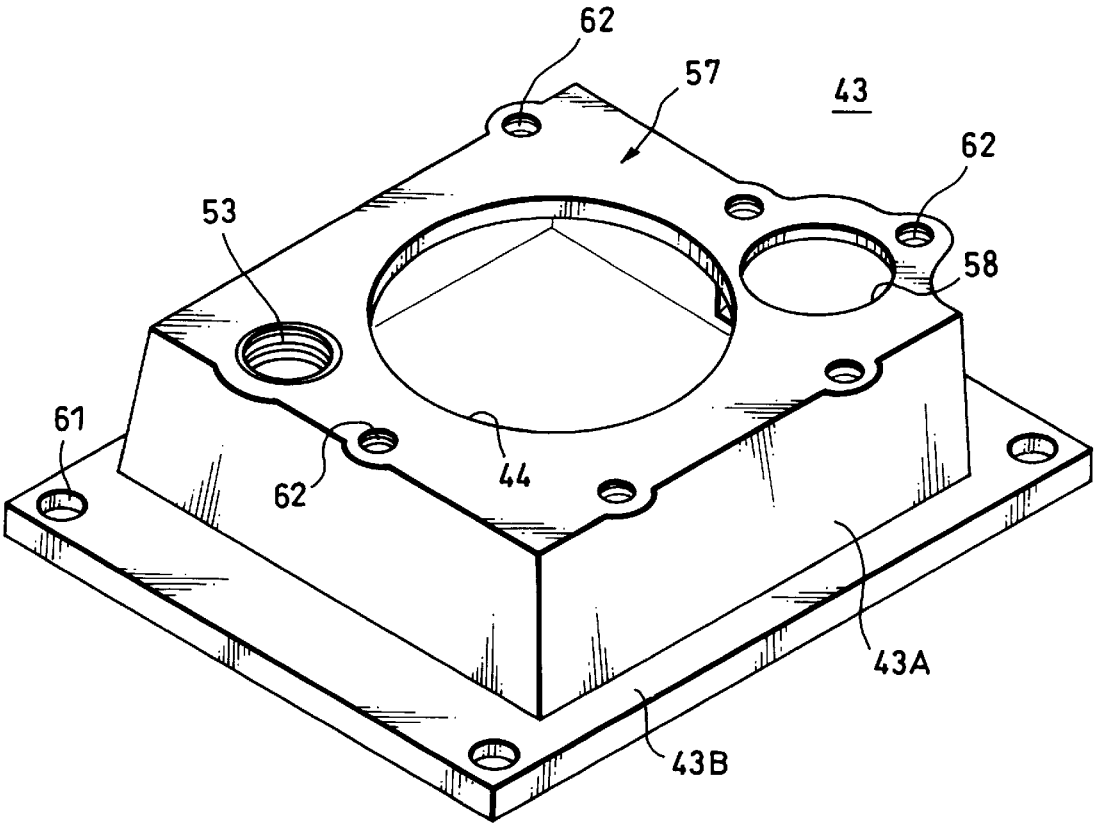
Figure 9:
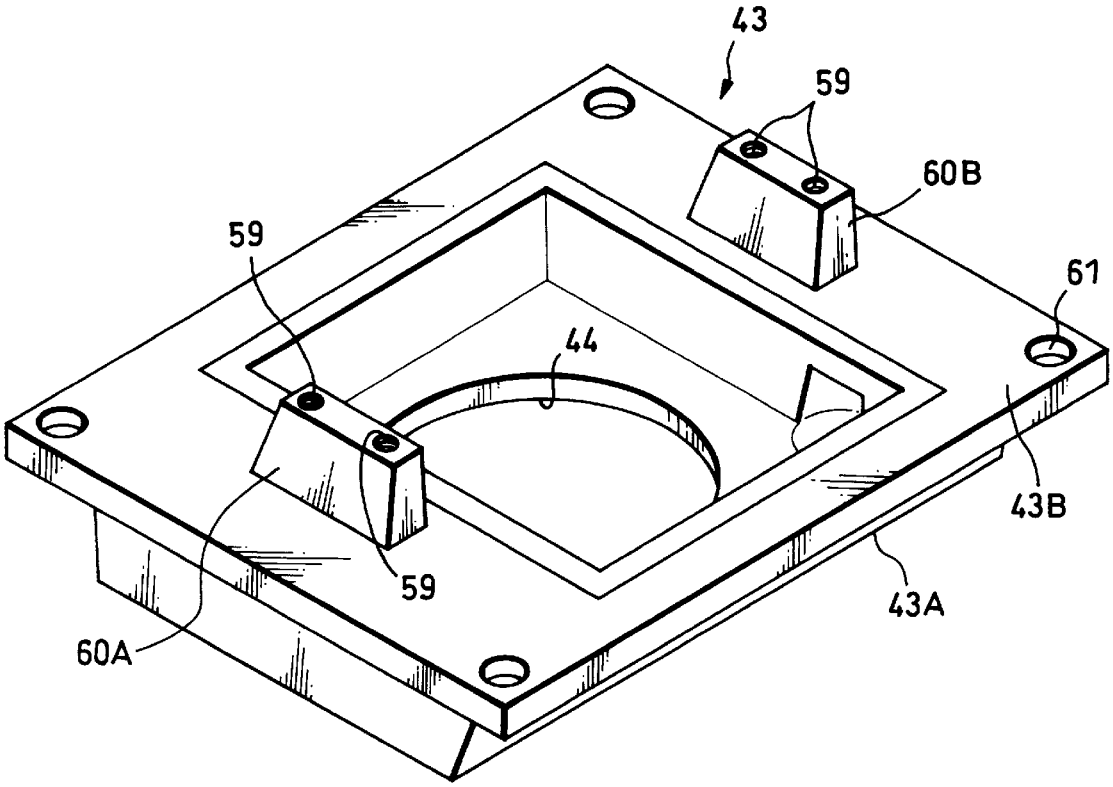
FIG. 9 is a perspective view of the coupler of FIG. 8 as seen from the rear side thereof.

The coupler 43 used in the present invention has a box portion 43A the panel front surface side of which is opened and a flange portion 43B which is integrally formed on the opened end portion of the box portion 43A, as shown in FIG. 8 and FIG. 9. On a front surface 57 of the box portion 43A, there are formed an opening portion 44 for mounting the final lens 45 thereon, the liquid fill hole 53 which is threaded on the inner surface thereof and a bore 58 for mounting the diaphragm 51, and on the rear surface of the flange portion 43B there are formed integrally therewith two opposing legs 60 (60A, 60B), each having a pair of threaded holes 59 on its tip end portion. Further, the coupler 43 has through holes 61 formed at the four corners of the flange portion 43B and a plurality of (for example six) threaded bores 62 on the periphery of the front surface 57 of the box portion 43A for mounting the lens fixing plate 50. The through holes 61 of the flange portion 43B, the threaded bores 62 of the front surface 57, the liquid fill hole (so-called fill threaded bore) 53 of the front surface 57 and the threaded holes 59 of the leg portion 60A, 60B are all formed in the direction along one axis direction, or the tubular axis of the cathode-ray tube body 42.

As shown in FIG. 8, the lens fixing plate 50 has, for example, a shape corresponding to the contour of the front surface 57 of the box portion 43A, opening portions 67, 68 on portions corresponding to the opening portions 44, 58 of the coupler 43 for mounting the final lens 45 and the diaphragm 51, respectively, and also openings 64, 65 on portions corresponding to the liquid fill hole 53 and the threaded bores 62, respectively. By the way, the lens fixing plate 50 may be formed such that the portion indicated by the dotted line in FIG. 8 corresponding to the liquid fill hole 53 is removed.

Figure 10:
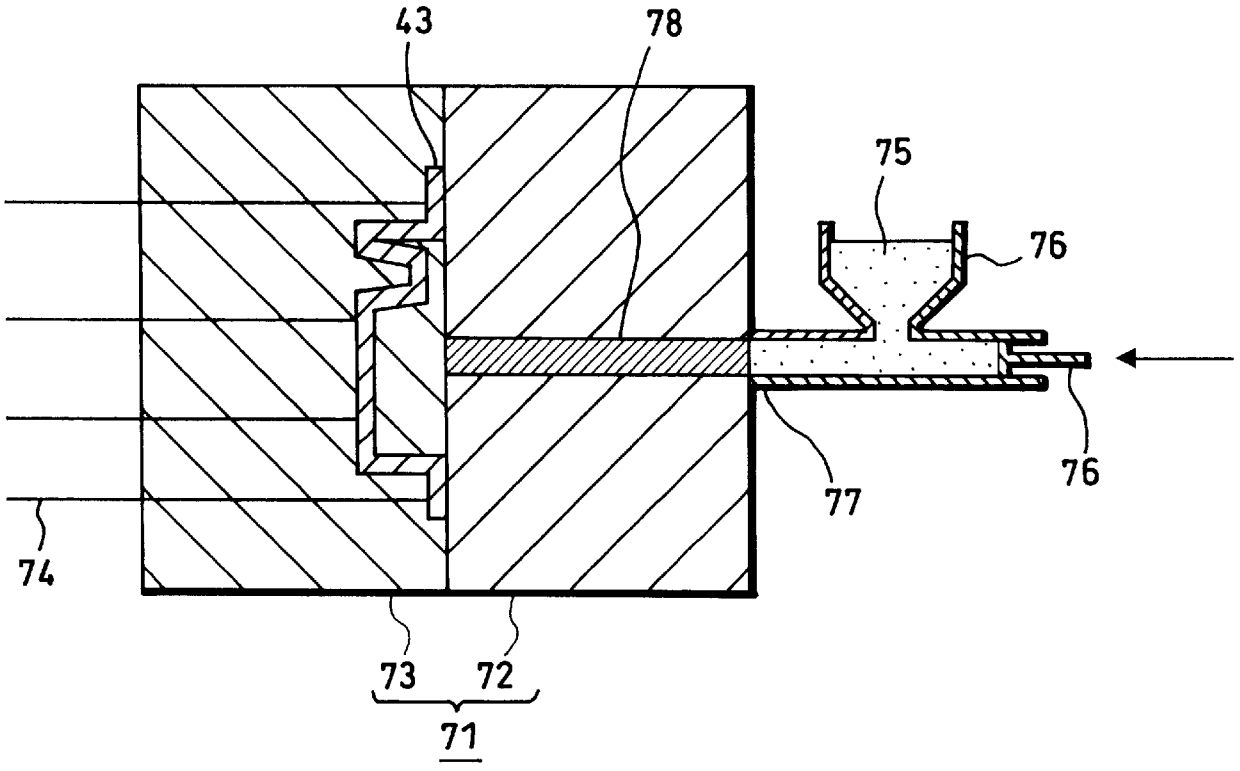
FIG. 10 is a schematic structural view showing a metal mold used for molding the coupler according to the present invention, wherein the metal mold is in a closed state.
Figure 11:
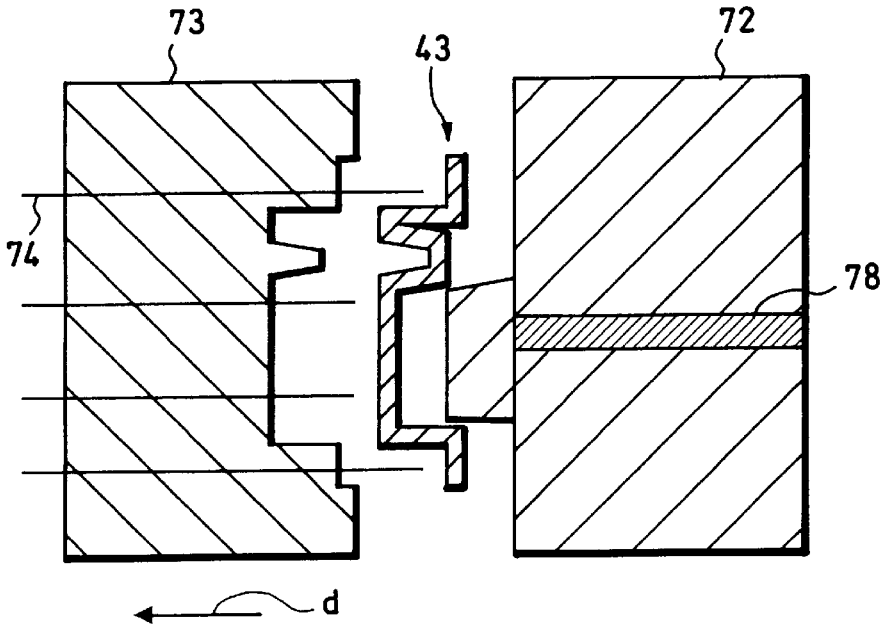
FIG. 11 is a schematic structural view of the metal mold of FIG. 10, wherein the metal mold is in an opened state.

The coupler 43 can be made by an aluminum-zinc die casting method using a metal mold for a die casting. FIG. 10 shows a metal mold assembly for molding the coupler 43 according to the present invention. This metal mold 71 is formed of two parts or a fixed mold 72 and a movable mold 73, and a cavity is formed in the space surrounded by the fixed mold 72 and the movable mold 73. The metal mold 71 is formed into such a structure that it is closed or opened by sliding the movable mold 73 relative to the fixed mold 72 in one direction. The reference numeral 74 indicates an ejector pin. When manufacturing the coupler 43, while the metal mold 71 is in a closed state as shown in FIG. 10, molten aluminum-zinc die casting material 75 is poured from a pouring gate 76 through a sprue 77 and a runner 78 into the cavity in the metal mold 71 by a cylinder 76. By cooling the aluminum-zinc die casting material 75 down in the cavity, the coupler 43 is molded as a product. When the molded coupler 43 is to be removed from the metal mold 71, the movable mold 73 is slid in an arrow direction d and the metal mold 71 is opened to take out the coupler 43, as shown in FIG. 11.

Figure 12:
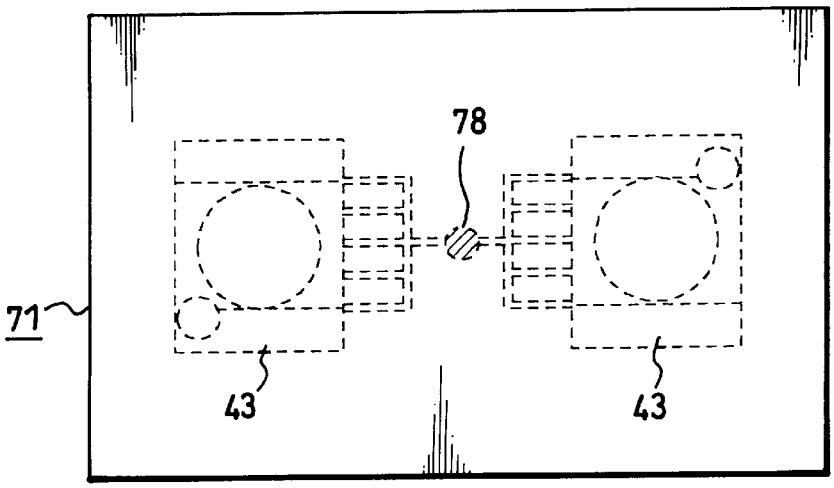
FIG. 12 is a schematic structural view of the metal mold shown in FIG. 10 (which is a case to make two pieces of products at once).

The metal mold 71 of the present embodiment is a case to make two pieces of products at once, as is shown in FIG. 12. Runner portions, flashes and so on are attached much to the product of coupler 43 just after its removal from the metal mold 71 and therefore, the runner portions and flashes are removed by a trimming mold or the like. Then, a threading process is performed by using a tapping machine or the like for the portions to be formed with threaded bores to form threaded bores, and finally a coating process for anti-corrosion coating is performed on the surface of the product of coupler 43.

According to the present invention described as above, since the opening portion 44 for mounting the final lens 45, the liquid fill hole 53 and the bore 58 for mounting the diaphragm 51 are all formed through the front surface 57 of the coupler 43, and the through holes 61 and the threaded bores 62, 59 are all formed in one axis direction, the structure of the coupler 43 itself can be simplified and the screw tightening process for mounting the coupler 43 or fixing the other parts to the coupler 43 can be performed only in one axis direction, in other words, in two-directions of the front and rear sides. Accordingly, both the assembly efficiency and the assembly precision of the liquid cooling type cathode-ray tube can be improved.

Further, because the lens fixing plate 50 can serve as the diaphragm holder also, the number of parts can be reduced.

Furthermore, since the through holes 61 and the threaded bores 62, 59 of the coupler 43 are all concentrated in one axis direction, the structure of the metal mold 71 for molding the coupler 43 can be simplified. Accordingly, the cost for making the metal mold can be reduced and the durability of the metal mold 71 can also be improved. The after-process to remove the runner, flash and so on after the removal of the molded product can be made easier and hence the cost of the coupler can be reduced.

According to the liquid cooling type cathode-ray tube for a projector of the present invention, since its cooling liquid sealing member is formed such that the liquid fill hole and the pressure regulating valve are formed on the front surface thereof and all of the mounting bores are formed in the tubular axis direction of the cathode-ray tube body, or one axis direction, the structure of the cooling liquid sealing member can be simplified, and the screw tightening process for mounting the cooling liquid sealing member or fixing the other parts to the cooling liquid sealing member can be performed only in one axis direction, with the result that the assembly efficiency and assembly precision of the cooling type cathode-ray tube can be improved.

Further, since the mounting bores of the cooling liquid sealing member are all concentrated in one axis direction, the structure of the metal mold for molding the cooling liquid sealing member can be simplified, the cost of the metal mold can be reduced and the durability thereof can be improved. As a result, the cost of the cooling liquid sealing member can be reduced.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claim is:

1. A liquid cooling type cathode-ray tube for a projector in which a cooling liquid sealing member is mounted on a front surface of a cathode-ray tube body and a cooling liquid is sealed in said cooling liquid sealing member, comprising:

a liquid fill hole;

a pressure regulating valve;

said liquid fill hole and said pressure regulating valve being provided on a front surface of said cooling liquid sealing member; and a number of mounting bores formed through said cooling liquid sealing member; said number of mounting bores being all formed in a tubular axis direction of said cathode-ray tube body.

* * * * *